US010676231B2

(12) United States Patent
Lu

(10) Patent No.: US 10,676,231 B2
(45) Date of Patent: Jun. 9, 2020

(54) CONTAINER WITH CLOSURE ARRANGEMENT RESTRICTING SPILLAGE

(71) Applicant: Hanpak Limited, Ballybrittas, Laois (IE)

(72) Inventor: Wei Lu, Ballymun (IE)

(73) Assignee: HANPAK LIMITED, Ballybrittas, Laois (IE)

( * ) Notice: Subject to any disclaimer, the term of this patent is extended or adjusted under 35 U.S.C. 154(b) by 0 days.

(21) Appl. No.: 16/305,635

(22) PCT Filed: May 29, 2017

(86) PCT No.: PCT/EP2017/062852
§ 371 (c)(1),
(2) Date: Nov. 29, 2018

(87) PCT Pub. No.: WO2017/207466
PCT Pub. Date: Dec. 7, 2017

(65) Prior Publication Data

US 2019/0337665 A1 Nov. 7, 2019

(30) Foreign Application Priority Data

May 31, 2016 (IE) ..... S2016/0145

(51) Int. Cl.
*B65D 3/20* (2006.01)
*B65D 3/06* (2006.01)

(52) U.S. Cl.
CPC ..... *B65D 3/20* (2013.01); *B65D 3/06* (2013.01)

(58) Field of Classification Search
CPC ..... B65D 3/20; B65D 3/06; B65D 5/0209; B65D 1/265
USPC ..... 229/404, 4.5, 5.5, 5.7, 405, 906.1
See application file for complete search history.

(56) References Cited

U.S. PATENT DOCUMENTS

| | | | | |
|---|---|---|---|---|
| 6,176,420 | B1 * | 1/2001 | Sarson | B65D 3/20 229/128 |
| D495,209 | S * | 8/2004 | Tranfaglia | D7/509 |
| 7,726,551 | B2 * | 6/2010 | Abbott | B65D 3/06 229/138 |
| 8,505,807 | B2 * | 8/2013 | Herman | B65D 1/265 229/128 |
| 9,751,655 | B2 * | 9/2017 | Herman | B65D 5/0209 |

FOREIGN PATENT DOCUMENTS

| | | | |
|---|---|---|---|
| GB | 2380397 | A | 4/2003 |
| WO | 2011063835 | A1 | 6/2011 |

* cited by examiner

*Primary Examiner* — Christopher R Demeree
(74) *Attorney, Agent, or Firm* — Hoffmann & Baron, LLP

(57) ABSTRACT

A container comprising a wall having outer and inner sides, a closed base at one end and a curved rim at an opposite end, the rim defining a top opening of the container; a pair of arcuate crease lines formed in the wall at opposite sides of the wall below the rim that define a flap and act as a hinge allowing each flap to toggle between an open upright position in which the flap is convex and a closed lowered position in which the flap changes its shape to concave; and a closure arrangement operable to restrict at least one flap opening; the closure arrangement comprising at least one closure leaf attached to a first one of the flap so as to be movable with the first flap and to extend underneath the first flap opening when the flaps are in the closed lowered position.

14 Claims, 10 Drawing Sheets

CONTAINER WITH CLOSURE ARRANGEMENT RESTRICTING SPILLAGE

This application claims priority from International Application No. PCT/EP2017/062852, filed on May 29, 2017, which claims priority from Irish patent application numbers S2016/0145, filed on May 31, 2016, both of which are incorporated herein in their entirety.

Field of the Invention

The present invention relates to containers for cold and hot beverages or food, and in particular to containers, which may be disposable or reusable, made from flexible resilient material, such as paperboard or plastics.

Background to the Invention

Known containers, whether disposable or reusable, such as, for example, those used in fast food outlets or in vending machines usually comprise a body in the form of an inverted truncated cone having a closed base and an open top. To prevent spilling of the contents of the container, a lid is usually placed over the opening of the container. Such lids are typically moulded from a plastics material. Such lids may also be formed from paper. A supply of matching lids needs to be maintained available for a user near the supply of containers at the vending location. Obviously, a lid has to be compatible with the opening of the container so as to fit securely over the rim of the container and to prevent spillage. There are a number of disadvantages associated with the use of such lids. Whilst having the same general configuration of a truncated cone, such containers come in different sizes and, therefore, for each container size, a different lid is normally required. Maintaining a stock of matching lids for every container size involves additional expense, requires additional storage space and managerial resources. Furthermore, it is often difficult to place even a matching lid over the container opening in a single attempt and typically some manipulation is required before the lid is finally properly put in place. Moreover, if the lid is pressed a little too hard against the rim of the container, the container can tumble and cause the contents inevitably to escape the container. Since most lids are provided with a spout/opening, there still remains a relatively high risk of spillage through the spout, e.g. when a person who is carrying the container walks or manipulates other objects, such as keys, mobile phone, etc. Due to the incessant popularity of fast food services, enormous amounts of containers and lids are being used and discarded all over the world on a daily basis. Whilst many containers are made from paperboard, which are renewable and recyclable, lids are often made from plastics which are far less environmentally friendly.

One known type of known container which seeks to provide an arrangement for closing a container in the form of a cup is disclosed in WO2011/063835. This known frusto-conical cup is made from a flexible resilient material, having a circular rim defining the top opening of the cup. A pair of arcuate crease lines is formed at the opposing sides of the wall of the cup below the rim defining a pair of flaps for closing the top opening of the cup by folding the flaps along the crease lines. Due to the resilience of the cup material, each flap can toggle between two stable positions on application of an initial external force on the flap, namely an open upright position in which the flap is convex and forms part of the wall of the cup, and a closed slanted position in which the flap changes its shape to concave. In the closed mode, the rim of one flap impinges against the inner face of the second flap. The flaps remain relatively rigid in the closed mode due to static opposing forces acting between the flaps. When the rim of one flap impinges against the inner face of the second flap there are gaps or flap openings between the flaps adjacent the ends of the crease lines, and these gaps provide openings through which the cup contents can be consumed, e.g. by tilting the cup or through a drinking straw. However, the cup contents can also splash or spill through the openings if the cup is shaken or otherwise subjected to impact.

A closure arrangement to reduce or restrict splashing and spillage of the cup contents through the flap openings is described in WO2013/175020. This closure arrangement provides a wing attached to the cup wall and extending radially inwardly from the cup wall. When the flaps of the cup are closed, the wing is positioned underneath the flap opening thereby restricting spillages. Whilst providing an efficient barrier to reduce splashes and spillages, there are a number of drawbacks associated with this arrangement. One drawback is that in use the wing projects radially inwardly from the cup wall underneath the location of the flap opening and this impedes pouring into the cup. Another drawback is that this arrangement may not always be reliable as not all wings may properly bend or click into position when the flaps of the cup are closed resulting in poor performance. Another drawback is that the wing has to be positioned close to the flap opening in order to restrict spillages. Additionally, the flap opening has to be relatively small. This can undesirably restrict flow during drinking. Due to its close position to the flap opening, portions of the wing may enter the flap opening and cause discomfort to the user during consumption. Furthermore, tolerances for making and positioning the wing are relatively tight, thereby rendering the manufacturing process relatively difficult.

In view of the above, it is an object of the present invention to alleviate and mitigate the above disadvantages and provide an improved closure arrangement for a container, whether disposable or reusable to reduce or restrict splashing and spillage of the container contents.

SUMMARY OF THE INVENTION

Accordingly; in a first aspect the present invention provides a container comprising a wall having an outer side, an inner side, a closed base at one end and a generally curved rim at an opposite end, the rim defining a top opening of the container, the container further comprising:

- a pair of substantially arcuate crease lines formed in the wall of the container at opposite sides of the wall below the rim; wherein each crease line has first and second ends coinciding with the rim; wherein each crease line and the portion of the rim between the first and second ends of the crease line define a flap having an outer face and an inner face; wherein each crease line is configured to act as a hinge allowing each flap to toggle between two positions upon application of an initial external force on the flap, the two positions being an open upright position in which the flap is convex and forms part of the wall of the container, and a closed lowered position in which the flap changes its shape to concave;
- wherein the container further comprises a closure arrangement operable to restrict at least one flap opening defined at or adjacent the positions where the ends of each crease line coincide with the rim of the container when the flaps are in the closed lowered position, wherein the closure arrangement comprises at least one closure leaf on the inner side of the container wall;

characterised in that the closure leaf is attached to a first one of the flaps at a location spaced from the position where the ends of the crease lines coincide with the rim at the flap opening being restricted and wherein the closure leaf is movable with the first flap; and wherein the closure leaf extends underneath the first flap opening downwardly spaced from the flap opening when the flaps are in the closed lowered position.

Preferably, the closure leaf is positioned upright and, preferably, concentrically with the first flap when the flaps are in the open upright position. In one arrangement; the closure leaf is superimposed on the first flap.

When the flaps are in the closed lowered position, the flap opening(s) is/are restricted by the closure leaf in that spills are prevented or reduced when the container is generally upright and is shaken or otherwise subjected to impact. However, the flap opening is preferably not sealed off completely by the closure leaf and passage of the container contents is still possible through the flap opening when the container is tilted, enabling drinking or pouring from the container. For this purpose, the closure leaf may be shaped appropriately, e.g. smaller than the top opening of the cup and/or with suitable one or more cut-outs, notches, holes or similar arrangements for allowing contents moving out from the container to bypass the closure leaf and exit the container through the flap opening. In some arrangements however, e.g. in food containers, the closure leaf may be sized and shaped to close off the top opening of the container fully. When the flap is moved into the open upright position, the closure leaf is also pivoted together with the flap away from the position in which the closure leaf restricts the flap opening and assumes the upright orientation together with the flap. This allows multiple containers to be stacked into each other in a space efficient manner. Also, the top opening of the container is unobstructed during pouring. When it is necessary to close the container by the flaps, the closure leaf is moved into the position in which the closure leaf restricts the flap opening in one motion simultaneously with the first flap. No separate action is necessary to move the closure leaf into the position in which the closure leaf restricts the flap opening. Furthermore, it is ensured with a high level of accuracy that the closure leaf is positioned correctly underneath the flap opening.

Preferably, a portion of the closure leaf proximal to the flap opening(s) is unattached to the first flap and the closure leaf is attached to the first flap by a portion distal from the flap opening.

In one arrangement, when the flaps are in the closed lowered position, the closure leaf extends tangentially in relation to the first flap, such that a portion of the closure leaf proximal to the flap opening is spaced apart from the first flap and the portion of the closure leaf distal from the flap opening is attached to the first flap.

In one arrangement, the closure leaf is made from a resiliently deformable material, such as, for example, a suitable type of paperboard or plastics. The closure leaf may be substantially planar, convex or concave when the flaps are in the closed lowered position and may bend to conform to the arcuate shape of the first flap when the flaps are in the open upright position.

Preferably, the closure leaf is attached to the first flap at a location spaced from the portion of the rim and the crease line which define the first flap. Preferably, the closure leaf is attached to the first flap at a location intermediate opposite ends of the portion of the rim and the crease line which define the first flap. The closure leaf may be attached to the first flap at a central location on the first flap.

The closure leaf may impinge against the inner side of the container wall underneath and downwardly spaced from the flap opening when the flaps are in the closed lowered position. Preferably, the portion of the closure leaf which impinges against the inner side of the cup wall has an edge portion shaped to conform to the inner side of the cup wall to further ensure that the contents of the container do not spill from the flap opening. Accordingly, splashing is minimised and the rate of spillage if the container is knocked over is reduced. The present invention thus improves the spill-resistant properties of the container, whilst, if required for drinking or pouring, permitting the container to allow the passage of the container contents when tilted for drinking and pouring. The closure leaf also imparts extra rigidity on the container in that the container is less prone to deformation when it is gripped by a user's hand.

A further advantage of the closure leaf of the present invention is that it can be relatively easily attached to a flat blank for forming the container during the manufacturing process of the container prior to forming the container into a three dimensional shape. Previously, a prior art wing could also be attached to a flat blank, but because it had to be attached to the container wall close to the location of a longitudinal seam in the container wall, positioning of adhesive area both on the wing and the flat blank had to be very accurately controlled. In addition, under prior art, two wings were generally required to protect two openings requiring more precision in relative positioning of the two wings than is required by the current invention which may require only one closure leaf to protect two openings. Since the closure leaf of the present invention can generally be attached to many locations on the inner side of the container wall on the flap, positioning of the closure leaf is simplified.

A further advantage of the closure leaf of the present invention is that it can be manufactured and positioned within the container to less strict tolerances than those of the prior art wing. Since the closure leaf is attached to the flap, it is spaced farther down towards the base of the container from the flap opening than a prior art wing and can cover a larger area than the prior art wing, while at the same time remaining stably attached to the flap. Accordingly, the same or improved efficiency in restricting spills is achieved with less precise dimensions and positioning. Since the closure leaf is spaced farther down from the flap opening than a prior art wing, a larger flap opening may be provided, for less restricted or improved flow during consumption; and the possibility of the closure leaf protruding into the flap opening and causing tactile discomfort to the user is eliminated.

The closure leaf may be of any suitable shape as required or desired, and may be adapted to have a shape specifically suited to the shape of the container and the function that is to be performed. For example, the closure leaf may be substantially round, oval, polygonal or irregular shaped as needed. Furthermore, the closure leaf may be formed with suitable one or more cut-outs, notches, holes or similar arrangements for allowing contents moving out from the container to bypass the closure leaf and exit the container through the flap opening. The closure leaf may be shaped to restrict only one flap opening of the container. The closure leaf may be shaped to restrict a pair of opposite flap openings of the container. If needed, the closure leaf may be shaped to close the top opening of the container fully when the flaps of the container are closed. One, two or more closure leafs may be provided, to restrict the flap openings as required.

The closure leaf may be made of the same material as the container, or may alternatively be made of a heavier gauge or a lighter gauge and/or an alternative material for additional strength or functionality.

In use, in order to close the container, the first flap, i.e. the one to which the closure leaf is attached is closed first and the other flap is closed second.

Each crease line may be configured such that the open upright position in which the flap is convex and forms part of the wall of the container, and the closed lowered position in which the flap changes its shape to concave are stable positions; wherein the resilience of the flap material causes the flap to complete the toggle and prevents the flap from stopping in a position intermediate the open upright and the closed lowered positions. The length of each crease line and the shortest distance between a point of the crease line axially most remote from the rim of the flap and the rim may be selected such that when the flaps are moved to the closed lowered position, each flap assumes a slanted orientation in relation to the base of the container, wherein the rim of a first flap impinges against the inner face of the second flap and wherein the two flaps form a double slope roof across the top opening of the container.

In one arrangement, when the flaps are closed a spill-tight seal may be formed between the rim of the first flap and an inner face of the second flap.

When one of the flaps, e.g. the first flap, is allowed to move fully into the closed lowered position, the second flap may be prevented from moving fully into the closed lowered position by the rim of the first flap. The rim of the first flap may be prevented from being deformed by the second flap due to the resilience of the material of the container, so that the second flap remains statically forced against the rim of the first flap towards the closed lowered position due to the resilience of the container material. The counteracting forces between the rim of the first flap and the inner face of the second flap may be sufficient to push the respective rim and the inner face together into a positive contact, which in some instances may help to form a seal between the flaps.

The flap openings remaining at or adjacent the location where opposite ends of the crease lines coincide with the rim of the container serve as drinking apertures, but, in absence of a closure arrangement, spillage of the container contents can also occur through these flap openings. It will be appreciated that only one flap opening may be formed when the flaps are in the closed lowered position. The provision of a closure leaf, according to the invention, is operable to restrict or protect the flap openings formed at the rim of the container when the flaps are moved into the closed lowered position, and so provides a means to prevent or improve against splashing of the container contents and reduce the rate of spillage if the container is knocked over. The present invention thus improves the spill-resistant properties for the container, whilst, if required for drinking or pouring, permitting the container to allow the passage of the container contents when tilted for drinking and pouring. The closure leaf of the present invention also permits stacking of multiple containers, unobstructed pouring of contents into the container and provides for correct positioning of the closure leaf underneath the flap opening in one movement simultaneously with the downward movement of the first flap.

Preferably, the closure leaf is connected to the first flap by an adhesive, by an ultrasonic weld and/or with the use of heat sealing.

The closure leaf may be integrally formed with the container.

The container may be made from a flexible resilient material.

Preferred materials for the container are flexible resilient materials such as paperboard or plastics, the paperboard being a more preferred material due to its ability to be recycled. Preferably, the container is a cup. Alternatively, the container is a jug, a carton or a vessel for drinking or for carrying or storing a liquid, semi-solid or solid contents.

In a second aspect, the present invention provides a container comprising a wall having an outer side, an inner side, a closed base at one end and a generally curved rim of at an opposite end, the rim defining a top opening of the container, the container further comprising:

at least one substantially arcuate crease line formed in the wall of the container below the rim; wherein the crease line has first and second ends coinciding with the rim; wherein the crease line and the portion of the rim between the first and second ends of the crease line define a flap having an outer face and an inner face; wherein the crease line is configured to act as a hinge allowing the flap to toggle between two positions upon application of an initial external force on the flap, the two positions being an open upright position in which the flap is convex and forms part of the wall of the container, and a closed lowered position in which the flap changes its shape to concave;

characterised in that the container further comprises a closure arrangement operable to restrict at least one flap opening defined between the portion of rim defining the flap and the inner side of the container wall when the flap is in the closed lowered position;

wherein the closure arrangement comprises at east one closure leaf on the inner side of the container wall;

wherein that the closure leaf is attached to the flap at a location spaced from the position where the ends of the crease line coincide with the rim, or at a location spaced from the portion of the rim and the crease line which defines the first flap, and wherein the closure leaf is movable with the flap; and wherein the closure leaf extends across the flap opening in plan view when the flap is in the closed lowered position.

The closure leaf may extend underneath the flap opening in side view when the flap is in the closed lowered position.

Such an arrangement may be particularly useful in a food container for holding viscous or solid foods (e.g. soup or finger food). The closure leaf in this arrangement prevents the contents from spilling, whereas the flap does not come into contact with the contents and remains clean on the inside and the outside when the flap is lifted. Any food particles will remain on the closure leaf and not on the flap. Accordingly, the container wall remains un-stained and the user receives a pleasant experience from using the container.

It will be appreciated that features of the first aspect of the invention can be incorporated into the second aspect mutatis mutandis.

It will be appreciated that the terms “inner”, “inwardly”, “outer”, “outwardly”, “axially”, “longitudinally” or similar are used in relation to a central longitudinal axis of the container. Accordingly, the terms “convex” and “concave” are to be understood as, respectively, “bent outwardly and inwardly in relation to the central axis”. It will also be appreciated that the terms “up”, “upper”, “upright”, “down”, “lower”, “downward”, “lowered” and “slanted” are used in relation to the base of the container.

DETAILED DESCRIPTION OF THE INVENTION

The invention will now be described with reference to the accompanying drawings which show, by way of example only, embodiments of a container according to the invention. In the drawings.

Figure 3:
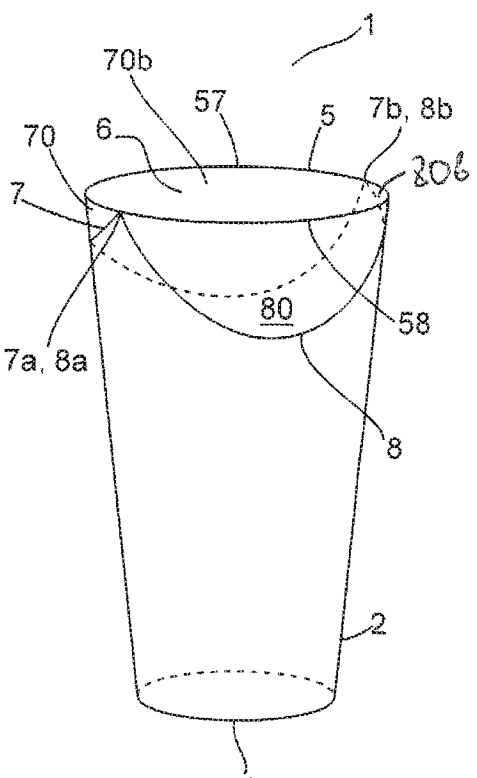
Fig. 3 (PRIOR ART)
FIGS. 1 to 7 are various views of a container formed as a cup according to the prior art.
Figure 2:
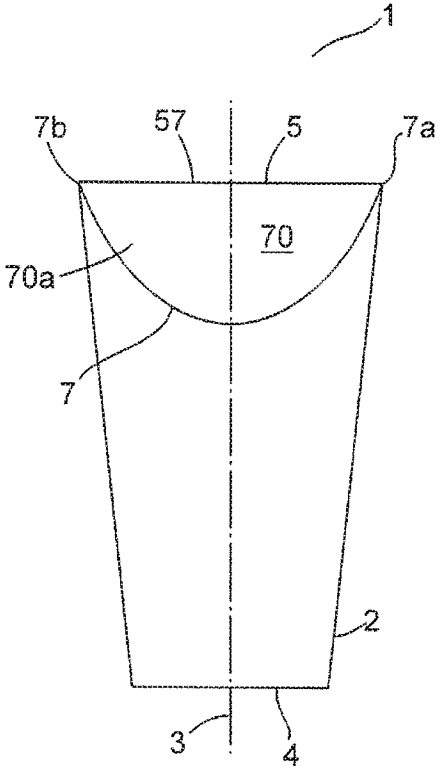
Fig. 2 (PRIOR ART)

Since the present invention is defined in the appended claims, the embodiments described below should not be construed as limiting the claimed invention. For example only, in the following description the features of the present invention will be described as they relate to a container embodied as a cup. However, it will be understood that other embodiments for a container are also envisaged, such as a jug, a carton, and a vessel for drinking or for carrying or storing a liquid, a semi-solid or solid contents, and that therefore reference in the following description to a container formed as a cup only should in no way be seen as limiting.

Referring initially to FIGS. 1 to 7, a cup in accordance with the prior art is indicated generally by reference numeral 1. The cup 1 is made from a flexible resilient material, such as paperboard or a plastics material.

The cup 1 has a wall 2 having a shape of a truncated cone having a central axis 3, a closed base 4 of an optionally smaller diameter at one end and a generally circular rim 5 of optionally larger diameter at an opposite end. It will be appreciated that the invention is not limited to a circular cross-section of the cup wall. Indeed, a generally curved, e.g. oval or other cross-section of the cup is within the scope of the present invention. It is also within the scope of the present invention to have a protruding spout or drinking opening. The rim 5 defines a top opening 6 of the cup 1. The rim 5 and base 4 may also be of the same diameter.

Figure 7:
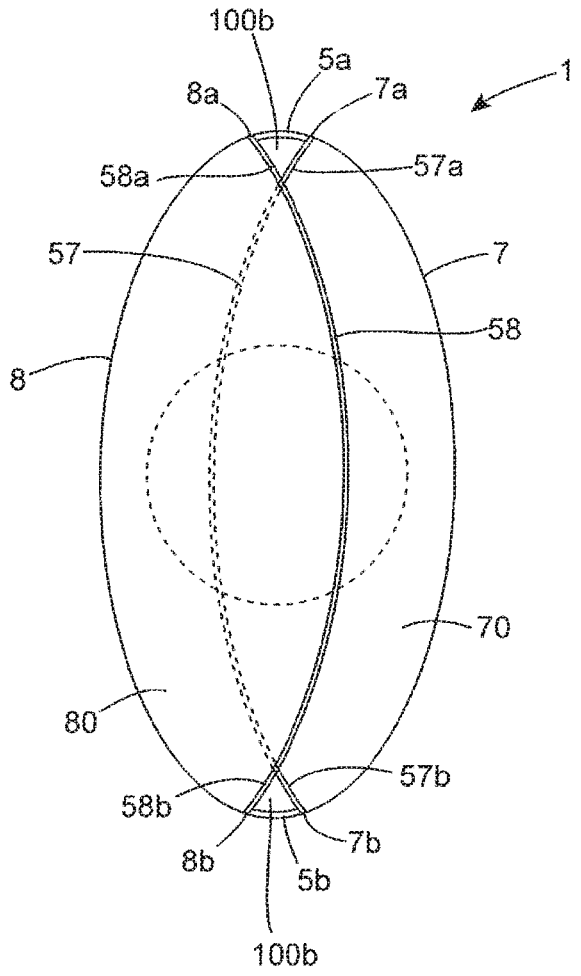
Fig. 7 (PRIOR ART)

A pair of substantially arcuate crease lines 7, 8 is formed in the wall 2 of the cup 1 at opposite sides of the wall 2 below the rim 5. Each crease line 7, 8 has first and second ends 7*a*, 8*a* and 7*b*, 8*b*, respectively. The ends of the crease lines 7*a*, 8*a*, 7*b*, 8*b* coincide with the rim 5. Also, each end 7*a*, 7*b* of a first crease line 7 substantially coincides with a corresponding end 8*a*, 8*b* of the second crease line 8 on the rim 5 of the cup, although it will be understood that in order to provide a container having a drinking or pouring spout or funnel, the ends 7*a*, 7*b*, 8*a*, 8*b* of the crease lines 7,8 may not coincide with each other at the rim 5 so as to create a sufficiently wide opening at the rim 5, as shown in FIG. 7 by gaps 5*a*, 5*b*, thereby creating a drinking or pouring funnel or opening 100*a*, 100*b*.

Each crease line 7, 8 and the respective portion 57, 58 of the rim 5 between the respective first and second ends 7*a*, 7*b*; 8*a*, 8*b* of the crease line 7, 8 define a flap 70, 80, respectively. Each flap 70, 80 has an outer face 70*a*, 80*a* and an inner face 70*b*, 80*b*, respectively.

Figure 1:
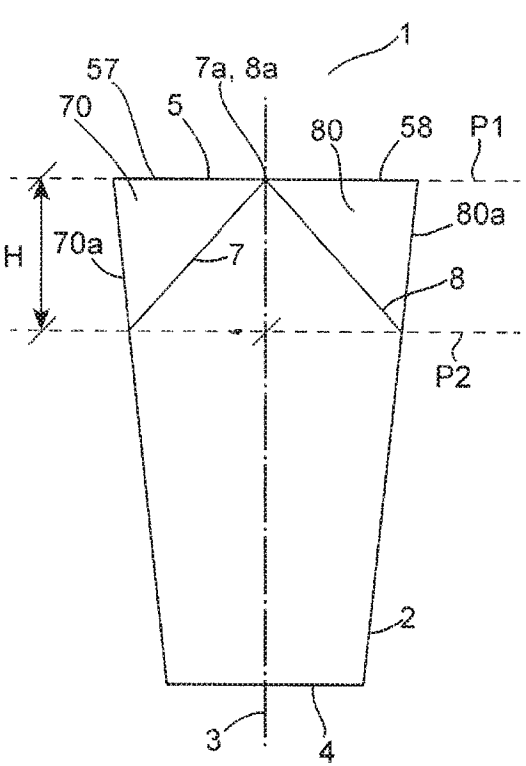
Fig. 1 (PRIOR ART)
Figure 5:
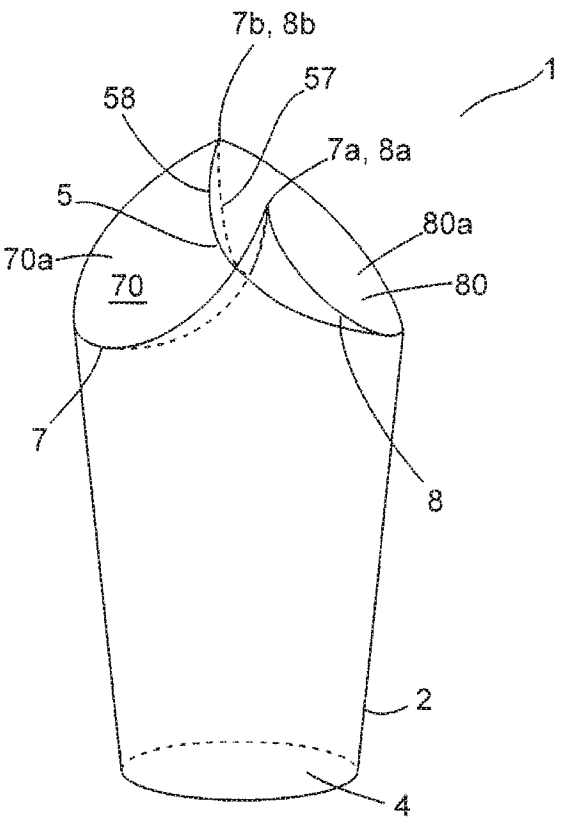
Fig. 5 (PRIOR ART)
Figure 4:
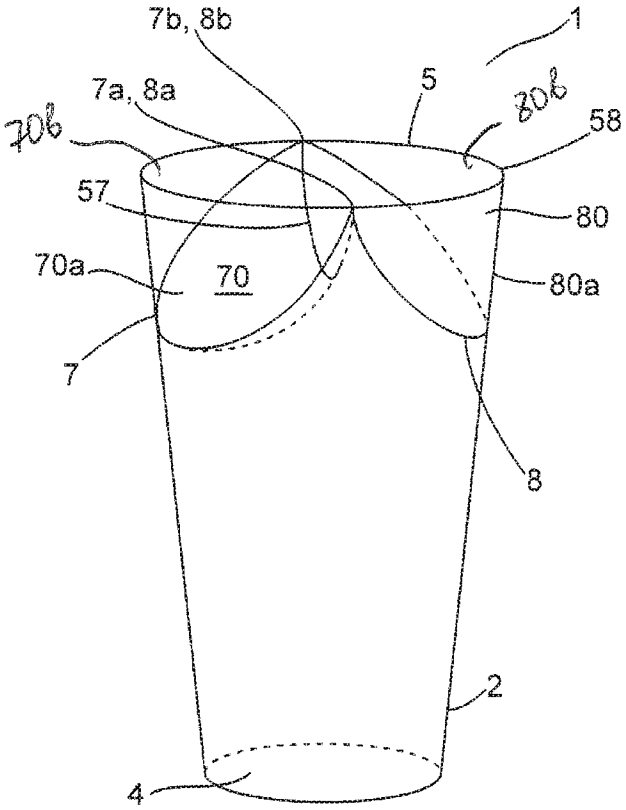
Fig. 4 (PRIOR ART)

Each crease line 7, 8 is configured using a suitable method (e.g, by bending, scoring or differential forming, such as in the case of plastic cups, the material of the wall 2) to act as a hinge to allow each flap 70, 80 to toggle between two stable positions upon application of an initial external force on the flap 70, 80, One of the two stable positions is an open upright position in which the flap 70, 80 is convex and forms part of the wall 2 of the cup, for example, as shown in FIG. 1. The second of the two stable positions is a closed lowered position in which the flap 70, 80 changes its shape to concave, for example, as shown in FIGS. 4 and 5. In the presently described embodiment, a flap 70, 80 is prevented from remaining in a position intermediate the open upright and the closed lowered positions due to the resilience of its material and because in an intermediate position the flap 70, 80 becomes distorted, e.g. corrugated, because the length of the flap 70, 80 in the circumferential directions is greater the length of a plane defined by the respective crease line 7, 8. When pushed into an intermediate position by an external force and upon subsequent removal of the external force, the flap 70, 80 assumes either the concave shape in the closed lowered position or the convex shape in the open upright position under the influence of the inherent resilience of the cup material. The resilience of the cup material causes the flap 70, 80 to complete the toggle without the need for the continued application of the external force and prevents the flap 70, 80 from stopping in a position intermediate the open upright and the closed lowered positions. It will be appreciated that in other embodiments, the two positions need not be stable.

Figure 6:
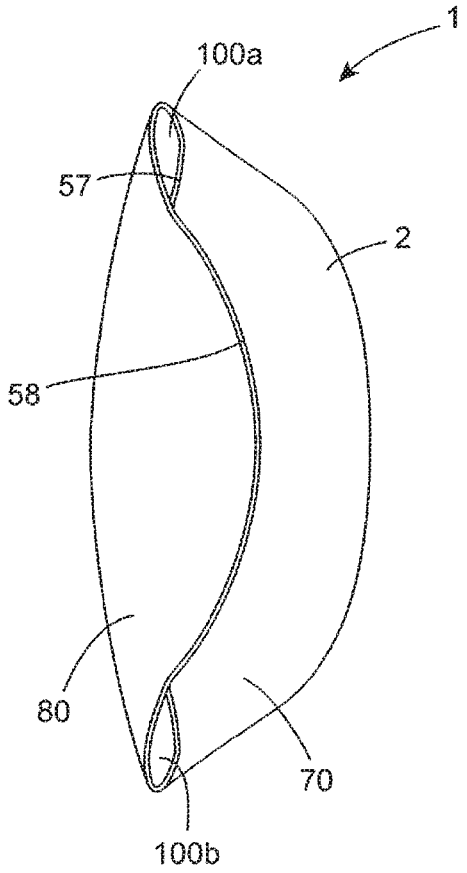
Fig. 6 (PRIOR ART)

The length of each crease line 7, 8 and the distance between points P1 and P2, as shown in FIG. 1, respectively, of the crease line 7, 8 axially most remote from the rim portions 57, 58 of the flap 70, 80 and the rim 5 are such that when the flaps 70, 80 are closed, each flap 70, 80 assumes a lowered, curved and/or angled orientation in relation to the base 4 of the cup 1. Furthermore, a first flap, e.g. flap 70, is allowed to move fully into the closed lowered position as shown in FIG. 4. The second flap, i.e. flap 80, is prevented from moving fully into the closed lowered position by the rim portion 57 of the first flap which impinges against the inner face 80*b* of the second flap 80 substantially along the full length of the rim portion 57 of the first flap 70. The rim portion 57 of the first flap 70 is prevented from being deformed by the second flap 80 due to the resilience of the material of the first flap 70 (i.e. the material of the cup 1), while the second flap 80 remains statically forced against the rim portion 57 of the first flap 70 towards the fully closed lowered position due to the resilience of the material of the second flap 80 (i.e. the material of the cup 1), as shown in FIG. 5. Due to the continuous forced contact between the rim portion 57 of the first flap 70 and the inner face 80*b* of the second flap 80, a spill-tight seal may be formed along the length of the rim portion 57 of the first flap 70. As shown in FIGS. 5 to 7, the two flaps 70, 80 form a double-slope roof across the top opening 6 of the cup 1. It will be appreciated that in other embodiments, the flaps may not be required to impinge against each other or to form a double-slope roof.

When the flaps 70, 80 are closed, there are noticeable gaps or flap openings 100*a*, 100*b* located near the ends 57*a*, 57*b*, 58*a*, 58*b* of the rim portions 57, 58 where the ends of the crease lines 7*a*, 8*a* and 7*b*, 8*b* coincide with the cup rim 5, and these openings provide an outlet through which spillage of the contents of the cup 1 may occur. The present invention now provides an improved closure arrangement to restrict or protect the flap openings 100*a*, 100*b* to thereby prevent or improve against splashing of the container contents when the container is in a generally upright position and reduce the rate of spillage if the container is knocked over. The present invention thus improves the spill-resistant properties for the container, whilst, if required for drinking or pouring, permitting the container to allow the passage of container contents when tilted for drinking and pouring. It will be understood that the ends of the crease lines 7*a*, 8*a* and 7*b*, 8*b* may not coincide with the rim 5 in order as to create a sufficiently wide opening at the rim 5 for the formation of a drinking and/or pouring spout or funnel.

Referring now to FIGS. 8 to 11, a cup in accordance with a first aspect of the invention is indicated generally by reference numeral 10. The cup 10 includes most of the features of the prior art cup 1 and for brevity parts of the cup 10 which are common with the prior art cup 1 have been indicated using common reference numerals. In one configuration of the invention, the closure arrangement comprises at least one closure leaf 130 for restricting each of the opposite gaps or flap openings 100*a*, 100*b* formed when the flaps 70, 80 are folded. Although the closure leaf 130 is shown in the drawings to restrict both flap openings 100*a*, 100*b*, it will be understood that the cup 10 may require the closure leaf 130 to restrict only one flap opening where a single flap opening is to be sealed or where only one flap opening is provided in the cup 10. For example, and depending on the specific application of the invention, it may be desirable to allow the container contents to have an unimpeded flow through one of the two flap openings, and to restrict flow through the other of the two flap openings, in which case the inclusion of a closure leaf 130 to restrict only one of the flap openings would be required. Reference to the closure leaf 130 as restricting one flap opening or restricting two opposite flap openings should therefore in no way be seen as limiting. Thus, depending on the specific requirements, the closure leaf 130 may be shaped to restrict only one flap opening of the cup 10. The closure leaf 130 also may be shaped to restrict both flap openings 70, 80 of the cup 10. Furthermore, a pair of closure leafs 130 may be provided on the same flap, to restrict respective opposite flap openings 70, 80.

In the presently described embodiment, in use, the closure leaf 130 is shaped to restrict the openings 100*a*, 100*b* from within the cup 10 to reduce splashing of the container contents.

The closure leaf 130 may be attached to a first one of the flaps 70, 80, for example, the flap 70, at a location A spaced from the position where the ends 7*a*, 8*a*, 7*b*, 8*b* of the crease lines 7, 8 coincide with the rim 5 at the flap opening 100*a*, 100*b* and the closure leaf 130 is movable with the first flap 70. In the presently described arrangement, the closure leaf 130 is attached to the first flap 70 at a central location on the first flap 70 spaced from the portion of the rim 5 and the crease line 7 which define the first flap 70. In use, in order to close the cup 10, the first flap 70 is closed first and the other flap 80 is closed second, as indicated by respective arrows I and II in FIGS. 8 and 10.

Figure 8:
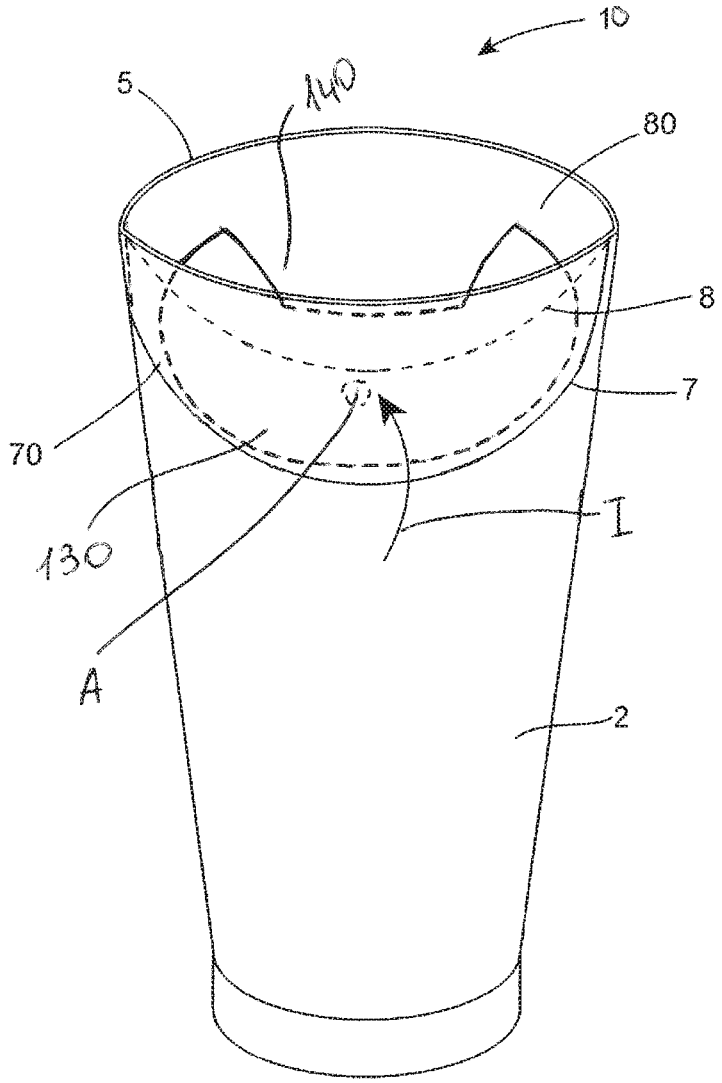
FIG. 8 is a perspective schematic view of a container formed as a cup showing a closure arrangement according to an embodiment of the first aspect of the invention.
Figure 9:
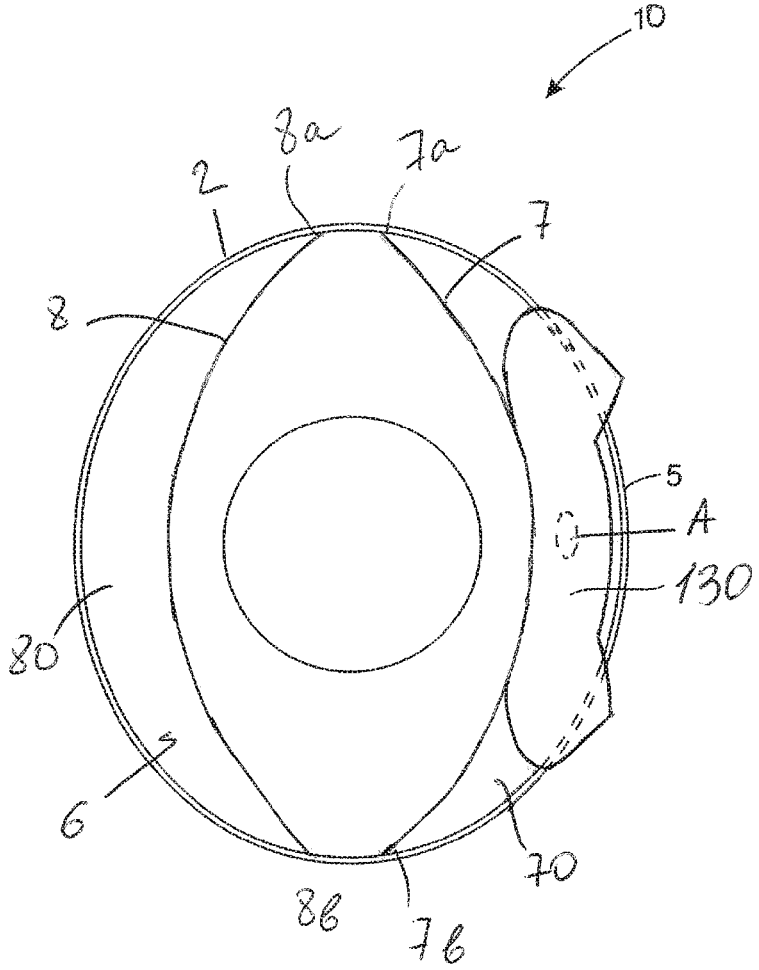
FIG. 9 is a plan view of the cup of FIG. 8.
Figure 10:
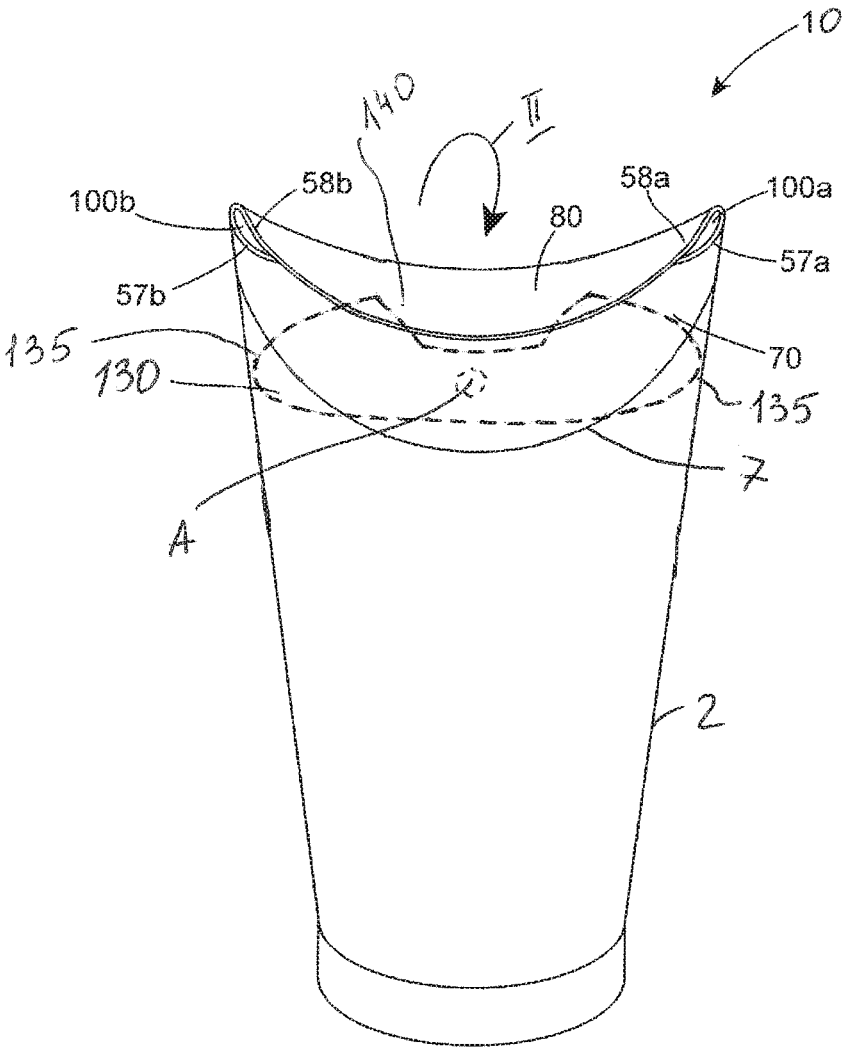
FIG. 10 is a perspective view of a fully closed cup of FIG. 9.
Figure 11:
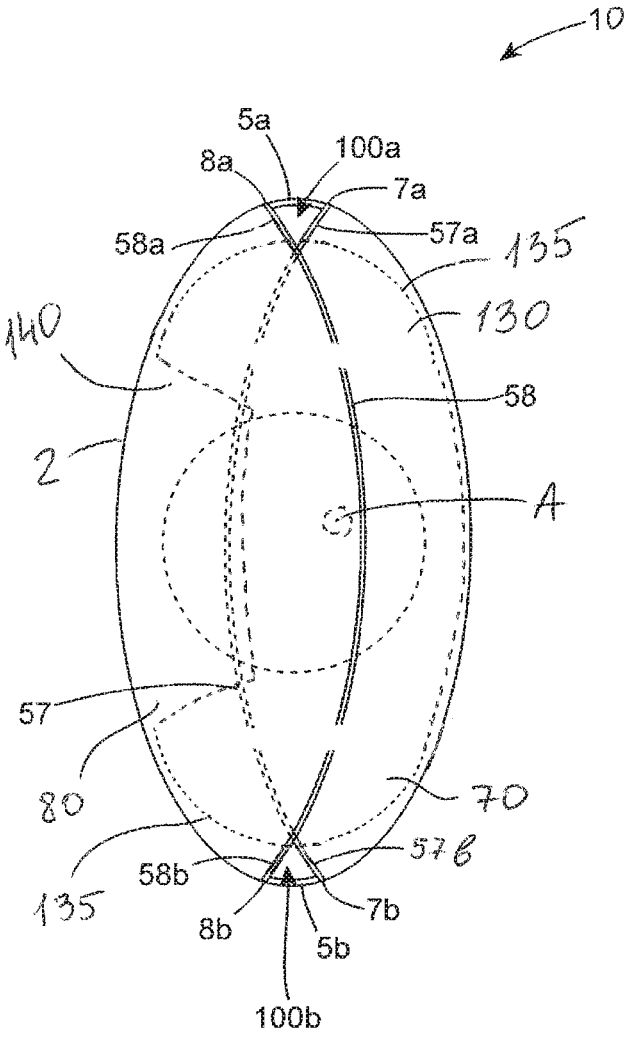
FIG. 11 is a plan view of FIG. 10.

In the presently described arrangement, the closure leaf 130 is substantially superimposed on the first flap 70. Also, in the presently described arrangement, when the flaps 70, 80 are in the open upright position, as shown in FIGS. 8 and 9, the closure leaf 130 is positioned upright and concentrically with the first flap 70. When the flaps 70, 80 are in the closed lowered position, as shown in FIGS. 10 and 11, the closure leaf 130 extends underneath the flap opening 100*a*, 100*b* downwardly spaced from the flap opening 100*a*, 100*b*.

When the flaps 70, 80 are in the closed lowered position, the flap opening 100*a*, 100*b* is restricted by the closure leaf 130 in that spills are prevented or minimised when the cup 10 is generally upright and is shaken or otherwise subjected to impact. However, the flap opening 100*a*, 100*b* is not sealed off completely by the closure leaf 130 as the closure leaf does not completely block the top opening 6 of the cup 10 and passage of the cup contents is still possible through the flap opening 100*a*, 100*b* when the cup 10 is tilted, enabling drinking or pouring from the cup 10. In the presently described arrangement, the closure leaf 130 provides a cut-out 140 to permit passage of cup contents and also to allow the flap and the closure leaf 130 to be held together to move them into the open upright position. In other arrangements, however, e.g. in food containers, the closure leaf 130 may be shaped to close off the top opening 6 of the container fully. When the flap 70 is moved into the open upright position, the closure leaf 130 is also pivoted together with the flap 70 away from the position in which the closure leaf 130 restricts the flap opening 100*a*, 100*b* and assumes the upright orientation together with the flap 70. This allows multiple cups 10 to be stacked into each other for efficient storage. Also, the top opening 6 of the cup 10 is unobstructed during filling. When it is necessary to close the cup 10 by the flaps 70, 80, the closure leaf 130 is moved into the position in which the closure leaf 130 restricts the flap opening 100*a*, 100*b* in one motion simultaneously with the first flap 70. No separate action is necessary to move the closure leaf 130 into the position in which the closure leaf 130 restricts the flap opening 100*a*, 100*b*, Furthermore, it is ensured that the closure leaf 130 will be positioned correctly underneath the flap opening 100*a*, 100*b*.

A portion of the closure leaf 130 proximal to the flap opening 100*a*. 100*b* is unattached to the first flap 70 and the closure leaf 130 is attached to the first flap 70 by a portion distal from the flap opening 100*a*, 100*b*. As best seen in FIG. 10, when the flaps 70, 80 are in the closed lowered position, the closure leaf 130 extends tangentially in relation to the first flap 70, such that a portion of the closure leaf 130 proximal to the flap opening 100*a*, 100*b* is spaced apart from the first flap 70 and the portion of the closure leaf 130 distal from the flap opening 100*a*, 100*b* is attached to the first flap 70. Since the closure leaf 130 is preferably made from a resiliently deformable material, such as, for example, a suitable type of paperboard or plastics, the closure leaf 130 may be substantially planar, or slightly convex or concave, when the flaps 70, 80 are in the closed lowered position and may bend to conform to the arcuate shape of the first flap 70 when the flaps 70, 80 are in the open upright position.

In one arrangement, when the flaps 70, 80 are in the closed lowered position, a spill-tight seal may be formed between the rim 5 of the first flap 70 and the inner face of the second flap 80.

The closure leaf 130 may impinge against the inner side of the cup wall 2 at a location underneath and downwardly spaced from the flap opening 100*a*, 100*b* when the flaps 70, 80 are in the closed lowered position. Preferably, the portion of the closure leaf 130 which impinges against the inner side of the cup wall 2 has an edge portion 135 shaped to conform to and engage the inner side of the cup wall 2 to further ensure that the contents of the cup 10 do not splash out of the flap opening 100*a*, 100*b*. Accordingly, splashing is minimised and the rate of spillage if the cup 10 is knocked over is reduced. The present invention thus improves the spill-resistant properties for the cup 10, whilst, if required for drinking or pouring, permitting the cup 10 to allow the passage of the cup contents when tilted for drinking and pouring. This also imparts extra rigidity on the cup 10 in that the cup 10 is less prone to deformation when it is gripped by a user's hand.

The closure leaf 130 of the present invention also permits stacking of multiple cups 10, unobstructed pouring of contents into the cup 10 and provides for correct positioning of the closure leaf 130 underneath the flap opening 100*a*, 100*b* in one movement, simultaneously with the downward movement of the first flap 70.

A further advantage of the closure leaf 130 of the present invention is that it can be relatively easily attached to a flat blank (not shown) for forming the cup 10 during the manufacturing process of the cup 10 prior to forming the cup 10 into a three dimensional shape. Previously, a prior art wing could also be attached to a flat blank, but because it had to be attached to the cup wall close to the location of a longitudinal seam (not shown) in the cup wall, positioning of adhesive area both on the wing and the flat blank had to be very accurately controlled. In addition, under prior art two wings were generally required to protect two openings requiring more precision in relative positioning of the two wings than is required by the current invention which may require only one closure leaf to protect two openings. Since the closure leaf 130 of the present invention can generally be attached to many locations on the inner side of the cup wall 2 on the flap 70, positioning of the closure leaf 130 is simplified.

A further advantage of the closure leaf 130 of the present invention is that it can be manufactured and positioned within the cup 10 to less strict tolerances than those of the prior art wing. Since the closure leaf 130 is attached to the flap 70, it is spaced farther down towards the base 4 of the cup 10 from the flap opening 100*a*, 100*b* than a prior art wing and can cover a larger area than the prior art wing, while at the same time remaining stably attached to the flap 70. Accordingly, the same or improved efficiency in restricting spills is achieved with less precise dimensions and positioning. Since the closure leaf 130 is spaced farther down from the flap opening 100*a*, 100*b* than a prior art wing, a larger flap opening 100*a*, 100*b* may be provided, for less restricted flow rate during consumption. Additionally, the possibility of the closure leaf 130 protruding into the flap opening 100*a*, 100*b* and causing tactile discomfort to the user is eliminated.

It will be understood that the closure leaf 130 may be of any suitable shape as required or desired, and may be adapted to have a shape specifically suited to the shape of the cup 10 and the function that is to be performed. For example, the closure leaf 130 may be substantially round, oval, polygonal or irregular shaped as needed. Furthermore, the closure leaf 130 may incorporate one or more suitable cut-outs, notches, holes or similar arrangements for allowing contents moving out from the cup 10 to bypass the closure leaf 130 and exit the cup 10 through the flap opening 100*a*, 100*b*. If needed, the closure leaf 130 may be shaped to close the top opening 6 of the container fully when the flaps 100*a*, 100*b* of the cup 10 are closed.

The closure leaf 130 may be made of the same material as the cup 10, or may alternatively be made of a heavier or lighter gauge and/or alternative material for additional strength or functionality.

Figure 12:
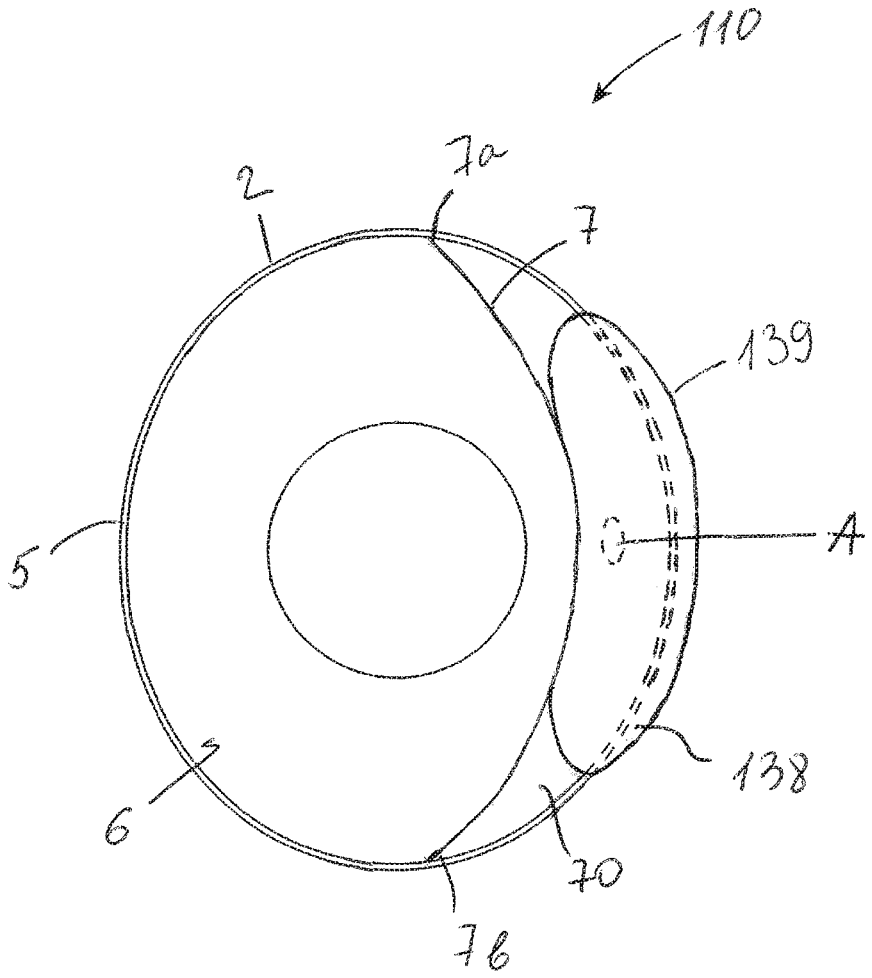
FIG. 12 is a schematic plan view of a container formed as a cup showing a closure arrangement according to an embodiment of the second aspect of the invention.
Figure 13:
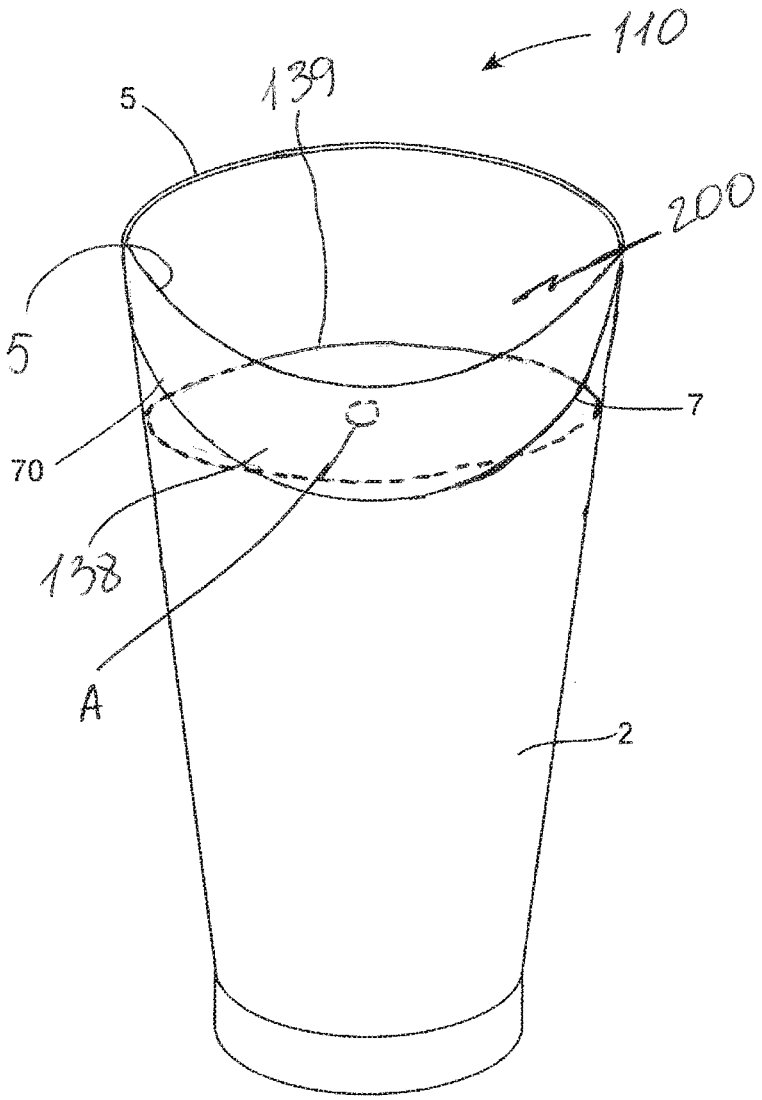
FIG. 13 is perspective view of a partially closed cup of FIG. 12.

Referring now to FIGS. 12 and 13, a cup in accordance with a second aspect of the invention is indicated generally by reference numeral 110. The cup 110 includes some of the features of the cup 10 and for brevity parts of the cup 110 which are common with the cup 10 have been indicated using common reference numerals. In the container 110, only one flap 70 is defined by one crease line 7 and the portion of the rim 5 between the first and second ends 7*a*, 7*b* of the crease line. A flap opening 200 is defined between the portion of rim 5 defining the flap 70 and the inner side of the container wall 2 when the flap 70 is folded down. The closure arrangement of this aspect of the invention comprises at least one closure leaf 138 on the inner side of the container wall 2 for restricting the flap opening 200. The closure leaf 138 is attached to the flap 70 at a location spaced from the position where the ends 7*a*. 7*b* of the crease line 7 coincide with the rim 5. The closure leaf 138 is movable with the flap 70 and extends across the flap opening 200, in plan view, and underneath the flap opening as viewed from a side, when the flap 70 is in the closed lowered position. A free outer edge portion of the closure leaf 138 may impinge against and/or conform to the shape of the inner side of the container wall 2 when the flap 70 is in the closed lowered position.

Such an arrangement may be particularly useful in a food container for holding viscous or solid foods (e.g. soup or finger food). The closure leaf 138 in this arrangement prevents the contents from spilling, whereas the flap 70 does not come into contact with the contents and remains clean on the inside and the outside when the flap 70 is lifted. Any food particles will remain on the closure leaf 138 and not on the flap 70. Accordingly, the cup wall 2 remains un-stained and the user receives a pleasant experience from using the cup 110.

In other modifications, the cup 110 may include two flaps, as in the cup 10. Other features of the cup 10 can be incorporated into the cup 110 mutatis mutandis.

It will be appreciated by those skilled in the art that variations and modifications can be made without departing from the scope of the invention.

The invention claimed is:

1. A container comprising a wall having an outer side, an inner side, a closed base at one end and a generally curved rim at an opposite end, the rim defining a top opening of the container, the container further comprising:

a pair of substantially arcuate crease lines formed in the wall of the container at opposite sides of the wall below the rim; wherein each crease line has first and second ends coinciding with the rim; wherein each crease line and the portion of the rim between the first and second ends of the crease line define a flap having an outer face and an inner face; wherein each crease line is configured to act as a hinge allowing each flap to toggle between two positions upon application of an initial external force on the flap, the two positions being an open upright position in which the flap is convex and forms part of the wall of the container, and a closed lowered position in which the flap changes its shape to concave;

a flap opening defined at or adjacent to a position where the ends of each crease line coincide with the rim of the container at opposite sides of the top opening of the container when the flaps are in the closed lowered position;

wherein the container further comprises a closure arrangement operable to restrict at least one said flap opening, wherein the closure arrangement comprises at least one closure leaf on the inner side of the container wall;

wherein the closure leaf is attached to a first one of the flaps at a location spaced from the position where the ends of the crease lines coincide with the rim at the flap opening being restricted and wherein the closure leaf is movable with the first flap; and wherein the closure leaf extends underneath said flap opening downwardly spaced from said flap opening when the flaps are in the closed lowered position.

2. The container as claimed in claim 1, wherein the closure leaf is positioned upright with the first flap when the flaps are in the open upright position.

3. The container as claimed in claim 2, wherein the closure leaf is positioned concentrically with the first flap when the flaps are in the open upright position.

4. The container as claimed in claim 2, wherein the closure leaf is substantially superimposed on the first flap.

5. The container as claimed in claim 1, wherein the closure leaf is shaped so as to restrict the flap opening when the flaps are in the closed lowered position to prevent spills when the container is in a generally upright position and to allow content moving out from the container to bypass the closure leaf and exit the container through the flap opening when the container is tilted.

6. The container as claimed in claim 1, wherein a portion of the closure leaf proximal to the flap opening is unattached to the first flap and the closure leaf is attached to the first flap by a portion distal from said flap opening.

7. The container as claimed in claim 1, wherein when the flaps are in the closed lowered position, the closure leaf extends tangentially in relation to the first flap, such that a portion of the closure leaf proximal to the flap opening is spaced apart from the first flap and the portion of the closure leaf distal from the flap opening is attached to the first flap.

8. The A container as claimed in claim 1, wherein the closure leaf is attached to the first flap at a location spaced from the portion of the rim and the crease line which define the first flap.

9. The container as claimed in claim 1, wherein the closure leaf is attached to the first flap at a location intermediate opposite ends of the portion of the rim and the crease line which define the first flap.

10. The container as claimed in claim 1, wherein the closure leaf is attached to the first flap at a central location on the first flap.

11. The container as claimed in claim 1, wherein the closure leaf impinges against the inner side of the container wall underneath and downwardly spaced from the flap opening when the flaps are in the closed lowered position.

12. The container as claimed in claim 11, wherein the portion of the closure leaf which impinges against the inner side of the cup wall has an edge portion shaped to conform to the inner side of the cup wall.

13. The container as claimed in claim 1, wherein each crease line is configured such that the open upright position in which the flap is convex and forms part of the wall of the container, and the closed lowered position in which the flap changes its shape to concave are stable positions; wherein the resilience of the flap material causes the flap to complete the toggle and prevents the flap from stopping in a position intermediate the open upright and the closed lowered positions; wherein the length of each crease line and the shortest distance between a point of the crease line axially most remote from the rim of the flap and the rim are selected such that when the flaps are moved to the closed lowered position, each flap assumes a slanted orientation in relation to the base of the container, wherein the rim of a first flap impinges against the inner face of the second flap and wherein the two flaps form a double slope roof across the top opening of the container and a spill-tight seal is formed between the rim of the first flap and an inner face of the second flap.

14. The container as claimed in claim 13, wherein when a first flap, is allowed to move fully into the closed lowered position, the second flap is prevented from moving fully into the closed lowered position by the rim of the first flap; wherein the rim of the first flap is prevented from being deformed by the second flap due to the resilience of the material of the container, so that the second flap remains statically forced against the rim of the first flap towards the closed lowered position due to the resilience of the container material;

wherein the counteracting forces between the rim of the first flap and the inner face of the second flap are sufficient to push the respective rim and the inner face together into a positive contact to form a seal between the flaps.

* * * * *